US011251541B2

(12) United States Patent
Luo et al.

(10) Patent No.: US 11,251,541 B2
(45) Date of Patent: Feb. 15, 2022

(54) DUAL-POLARIZED ANTENNA, RADIO FREQUENCY FRONT-END APPARATUS, AND COMMUNICATIONS DEVICE

(71) Applicant: HUAWEI TECHNOLOGIES CO., LTD., Guangdong (CN)

(72) Inventors: Chaoming Luo, Shenzhen (CN); Keli Zou, Chengdu (CN); Guangjian Wang, Chengdu (CN); Guolong Huang, Chengdu (CN)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 0 days.

(21) Appl. No.: 16/923,287

(22) Filed: Jul. 8, 2020

(65) Prior Publication Data

US 2020/0343649 A1 Oct. 29, 2020

Related U.S. Application Data

(63) Continuation of application No. PCT/CN2018/122934, filed on Dec. 22, 2018.

(30) Foreign Application Priority Data

Jan. 27, 2018 (CN) ..... 201810080107.X

(51) Int. Cl.
*H01Q 25/00* (2006.01)
*H01Q 13/02* (2006.01)
(Continued)

(52) U.S. Cl.
CPC ..... *H01Q 25/001* (2013.01); *H01Q 13/02* (2013.01); *H01Q 13/0275* (2013.01); *H01Q 13/085* (2013.01); *H01Q 21/064* (2013.01)

(58) Field of Classification Search
CPC .... H01Q 25/001; H01Q 13/02; H01Q 13/085; H01Q 21/24; H01Q 13/06; H01Q 21/064; H01Q 13/0275; H01Q 19/08; H01Q 5/55
See application file for complete search history.

(56) References Cited

U.S. PATENT DOCUMENTS 4,672,384 A 6/1987 Roy et al.
6,538,614 B2 * 3/2003 Fleming ..... H01Q 9/045 343/767

(Continued)

FOREIGN PATENT DOCUMENTS

CN 102255144 A 11/2011
CN 202121061 U 1/2012

(Continued)

OTHER PUBLICATIONS

Esmaeili Mahbubeh et al: Coaxial-fed dual-layer SIW horn antenna with improved E-plane radiation pattern 2017 47th European Microwave Conference(EUMC) European Microwave Association Oct. 10, 2017 pp. 66-69, XP033284599.

(Continued)

*Primary Examiner* — Vibol Tan
(74) *Attorney, Agent, or Firm* — Westerman, Hattori, Daniels & Adrian, LLP

(57) ABSTRACT

This application discloses a dual-polarized antenna, a radio frequency front-end apparatus, and a communications device. The dual-polarized antenna is a planar antenna, and a maximum radiation direction of the dual-polarized antenna is parallel to an antenna plane. A radio frequency circuit may be disposed at a side opposite to the maximum radiation direction of the dual-polarized antenna and located on a same circuit board as the dual-polarized antenna. A low profile feature is implemented, and the radio frequency circuit and the dual-polarized antenna do not need to be (Continued)

connected by using an interconnection plug, thereby reducing an insertion loss and reducing an assembly difficulty.

18 Claims, 11 Drawing Sheets

(51) Int. Cl.
*H01Q 13/08* (2006.01)
*H01Q 21/06* (2006.01)

(56) References Cited

U.S. PATENT DOCUMENTS

| | | | | |
|---|---|---|---|---|
| 8,422,540 | B1 * | 4/2013 | Negus | H01Q 21/062 375/219 |
| 9,142,889 | B2 * | 9/2015 | Pazin | H01Q 13/106 |
| 9,537,224 | B2 * | 1/2017 | Friedman | H04B 7/04 |
| 10,483,655 | B2 * | 11/2019 | Vouvakis | H01Q 21/24 |
| 10,715,199 | B1 * | 7/2020 | Kimball | H04B 17/12 |
| 2009/0066597 | A1 | 3/2009 | Yang et al. | |
| 2017/0222333 | A1 | 8/2017 | Sudo et al. | |
| 2017/0294705 | A1 | 10/2017 | Khripkov et al. | |
| 2018/0069322 | A1 * | 3/2018 | Vouvakis | H01Q 21/24 |

FOREIGN PATENT DOCUMENTS

| | | | |
|---|---|---|---|
| CN | 103618145 | A | 3/2014 |
| CN | 106299618 | A | 1/2017 |
| CN | 106450702 | A | 2/2017 |
| CN | 107369887 | A | 11/2017 |

OTHER PUBLICATIONS

Extended Search Report dated Nov. 23, 2020, issued in counterpart EP Application No. 18902585.1 (9 pages).
Office Action dated Nov. 28, 2019, issued in counterpart CN Application No. 201810080107.X, with English Translation. (11 pages).
International Search Report dated Apr. 2, 2019, issued in counterpart Application No. PCT/CN2018/122934, with English translation. (11 pages).

* cited by examiner

DUAL-POLARIZED ANTENNA, RADIO FREQUENCY FRONT-END APPARATUS, AND COMMUNICATIONS DEVICE

CROSS-REFERENCE TO RELATED APPLICATIONS

This application is a continuation of international application No. PCT/CN2018/122934, filed on Dec. 22, 2018, which claims priority to Chinese Patent Application No. 201810080107.X, filed on Jan. 27, 2018. The disclosures of the aforementioned applications are hereby incorporated by reference in their entireties.

TECHNICAL FIELD

The present invention relates to the field of antennas, and in particular, to a dual-polarized antenna, a radio frequency front-end apparatus, and a communications device.

BACKGROUND

As an apparatus for transmitting and receiving an electromagnetic wave, an antenna is an important part of a wireless communications system. A dual-polarized antenna can simultaneously transmit or receive two electromagnetic wave signals of which polarization directions are orthogonal, and this is equivalent to providing two transmission channels on a frequency band, so that reliability of the wireless communications system can be effectively improved.

FIG. 1*a* and FIG. 1*b* are schematic structural diagrams of a related art dual-polarized antenna. The dual-polarized antenna is a planar antenna, and the dual-polarized antenna includes a radiation patch, a dielectric plate 1, a microstrip L1 and a microstrip L2 that are orthogonal to each other, a dielectric plate 2, and a metal floor in sequence from top to bottom. The microstrip L1 is configured to couple and excite the radiation patch. A maximum radiation direction of an electromagnetic wave signal generated by excitation is perpendicular to an antenna plane, and a polarization direction is parallel to the microstrip L1 and parallel to the antenna plane. The microstrip L2 is configured to couple and excite the radiation patch. A maximum radiation direction of an electromagnetic wave signal generated by excitation is perpendicular to the antenna plane, and a polarization direction is parallel to the microstrip L2 and parallel to the antenna plane. Therefore, two polarization directions of the dual-polarized antenna are orthogonal to each other and are parallel to the antenna plane, and the maximum radiation direction is perpendicular to the antenna plane.

To avoid interference caused by the antenna to a radio frequency circuit, the radio frequency circuit is usually placed in a place with minimum radiation energy of the antenna. Based on an antenna pattern of a related art dual-polarized antenna, the radio frequency circuit is placed in a radiation back lobe direction of the dual-polarized antenna and is perpendicular to the antenna plane, and the radio frequency circuit and the dual-polarized antenna form a three-dimensional structure. Therefore, it is difficult to realize miniaturization and integration of a device. In addition, the radio frequency circuit needs to be connected to the dual-polarized antenna by using an interconnection plug. This connection manner causes a significant increase in an insertion loss. Meanwhile, due to a limitation of a wavelength, a volume of the interconnection plug is very small. Therefore, a requirement on an assembly process is high.

SUMMARY

A technical problem to be resolved by embodiments of the present invention is to provide a dual-polarized antenna, a radio frequency front-end apparatus, and a communications device. A maximum radiation direction of the dual-polarized antenna is parallel to an antenna plane, so that a radio frequency circuit and the dual-polarized antenna may be disposed on a same circuit board, and connection by using an interconnection plug is avoided, and a feature of a low profile is implemented.

A first aspect of this application provides a dual-polarized antenna, where the dual-polarized antenna is a planar antenna, and the dual-polarized antenna includes an H-plane horn antenna and a planar end-fire antenna. A polarization direction of the H-plane horn antenna is perpendicular to an antenna plane, and the antenna plane in this application may be an upper surface or a lower surface of the dual-polarized antenna. A polarization direction of the planar end-fire antenna is parallel to the antenna plane of the dual-polarized antenna, polarization directions of the H-plane horn antenna and the planar end-fire antenna are perpendicular to each other, and a maximum radiation direction of the dual-polarized antenna is parallel to the antenna plane, and is perpendicular to the polarization direction of the H-plane horn antenna and the polarization direction of the planar end-fire antenna.

A horn antenna is a technical term in this field. The horn antenna includes an E-plane horn antenna, the H-plane horn antenna, a conic horn antenna, or a conical horn antenna. Only the H-plane horn antenna has a planar feature. As a planar antenna, the H-plane horn antenna may be an H-plane horn antenna based on an SIW (substrate integrated waveguide), and the polarization direction is perpendicular to the antenna plane. The planar end-fire antenna is also a planar antenna, and the polarization direction of the planar end-fire antenna is parallel to the antenna plane. The planar end-fire antenna includes but is not limited to a Vivaldi antenna, a planar Yagi antenna, and a planar log-periodic antenna.

In a possible design, the H-plane horn antenna includes a first feeding part, a first metal via hole array, a second metal via hole array, a first metal floor, and a second metal floor, where the first metal floor is parallel to the second metal floor, the first metal via hole array is located between the first metal floor and the second metal floor, the first metal via hole array is perpendicular to the first metal floor and the second metal floor, and a top end of the first metal via hole array is connected to the first metal floor, and a bottom end of the first metal via hole array is connected to the second metal floor; the second metal via hole array is located between the first metal floor and the second metal floor and is perpendicular to the first metal floor and the second metal floor, a top end of the second metal via hole array is connected to the first metal floor, and a bottom end of the second metal via hole array is connected to the second metal floor; and the first metal floor, the second metal floor, the first metal via hole array, and the second metal via hole array form a waveguide cavity, and the first feeding part is configured to feed the waveguide cavity; and the planar end-fire antenna includes a second feeding part and a radiation patch, where the radiation patch is parallel to the first metal floor and the second metal floor, and the second feeding part is configured to feed the radiation patch.

In a possible design, a distance between the first metal via hole array and the second metal via hole array gradually increases.

In a possible design, the distance between the first metal via hole array and the second metal via hole array first remains unchanged and then gradually increases.

In a possible design, the first metal via hole array is parallel to the second metal via hole array.

In a possible design, the dual-polarized antenna further includes a first dielectric plate, a second dielectric plate, a first feeding layer, and a second feeding layer, where the first dielectric plate is disposed on a lower surface of the first metal floor, and the first feeding layer is disposed on an upper surface of the first metal floor; and the second dielectric plate is disposed on an upper surface of the second metal floor, and the second feeding layer is disposed between the lower surface of the first dielectric plate and the upper surface of the second dielectric plate. Through holes are disposed on the first dielectric plate, the second feeding layer, and the second dielectric plate, and the through-holes are used for the first metal via hole array and the second metal via hole array to pass through.

In a possible design, the first feeding part includes a first microstrip and a feeding probe, where the first microstrip is connected to the feeding probe, a through hole is disposed between the first feeding layer and the second metal floor, and the through hole is used for the feeding probe to pass through; and the second feeding part includes a second microstrip, where the second microstrip is disposed between the lower surface of the first dielectric plate and an upper surface of the second feeding layer, the radiation patch is disposed between a lower surface of the second feeding layer and the upper surface of the second dielectric plate, a rectangular area and a horn-shaped area that are in communication with each other are formed in an area that is of the upper surface of the second dielectric layer and that is not covered by the radiation patch, and a horn mouth of the horn-shaped area is perpendicular to the maximum radiation direction.

In a possible design, the metal via hole array includes three metal via hole arrays that are in a shape of a half-encircled rectangle.

In a possible design, the dual-polarized antenna further includes a first dielectric plate and a second dielectric plate, where the first dielectric plate is disposed on the upper surface of the first metal floor, and the second dielectric plate is disposed between the first metal floor and the second metal floor.

In a possible design, the first feeding part includes a first microstrip and a feeding probe, where the first microstrip is disposed on an upper surface of the first dielectric plate, the first microstrip is connected to the feeding probe, a through hole is disposed on the upper surface of the first dielectric plate, and the feeding probe is located in the through hole. The second feeding part includes a second microstrip, where the second microstrip and the radiation patch are disposed on the first dielectric plate.

According to a second aspect, this application provides a radio frequency front-end apparatus, including a radio frequency circuit board, a radio frequency circuit, and any dual-polarized antenna described above, where the dual-polarized antenna and the radio frequency circuit are disposed on the radio frequency circuit board, an antenna plane of the dual-polarized antenna is parallel to the radio frequency circuit board, that is, a maximum radiation direction of the dual-polarized antenna is parallel to the radio frequency circuit board, a polarization direction of an H-plane horn antenna is perpendicular to the radio frequency circuit board, a polarization direction of a planar end-fire antenna is parallel to the radio frequency circuit board, and the maximum radiation direction of the dual-polarized antenna, the polarization direction of the H-plane horn antenna, and the polarization direction of the planar end-fire antenna are perpendicular to each other.

According to a third aspect, this application provides a communications device, where the communications device includes the foregoing radio frequency front-end apparatus.

According to the foregoing embodiments, the dual-polarized antenna is the planar antenna, and the maximum radiation direction of the dual-polarized antenna is parallel to the antenna plane. In this way, the radio frequency circuit may be disposed at a side opposite the maximum radiation direction of the dual-polarized antenna and located on a same circuit board as the dual-polarized antenna, a feature of a low profile is implemented, and the radio frequency circuit and the dual-polarized antenna do not need to be connected by using an interconnection plug, thereby reducing an insertion loss and reducing an assembly difficulty.

BRIEF DESCRIPTION OF DRAWINGS

To describe the technical solutions in embodiments of the present invention or in the background more clearly, the following briefly describes the accompanying drawings required for describing the embodiments of the present invention or the background.

DESCRIPTION OF EMBODIMENTS

The following describes embodiments of the present invention with reference to the accompanying drawings in the embodiments of the present invention.

A communications device in this application is a device having a wireless communications function, and may be a handheld device, a vehicle-mounted device, wearable equipment, a computing device that has the wireless communications function, another processing device connected to a wireless modem, or the like. In different networks, a terminal device may have different names, for example, user equipment, an access terminal, a subscriber unit, a subscriber station, a mobile station, a mobile console, a remote station, a remote end, a mobile device, a user terminal, a terminal, a wireless communications device, a user agent or a user apparatus, a cellular phone, a cordless telephone set, a session initiation protocol (SIP) phone, a wireless local loop (WLL) station, a personal digital assistant (PDA), and a terminal device in a 5G network or a future evolved network.

The communications device in this application may also be a device that is deployed in a radio access network and that is configured to provide the wireless communications function, and the communications device includes but is not limited to a base station (for example, a base transceiver station (BTS)), a Node B (NB), an evolved Node B (eNB, or eNodeB), a transmission node, a transmission reception point (TRP or TP), or a next generation Node B (gNB) in a NR system, or a base station or a network device in a future communications network), a relay site, an access point, a vehicle-mounted device, wearable equipment, a wireless-fidelity (Wi-Fi) site, a radio backhaul node, a small cell, a micro cell, or the like.

Figure 1A:
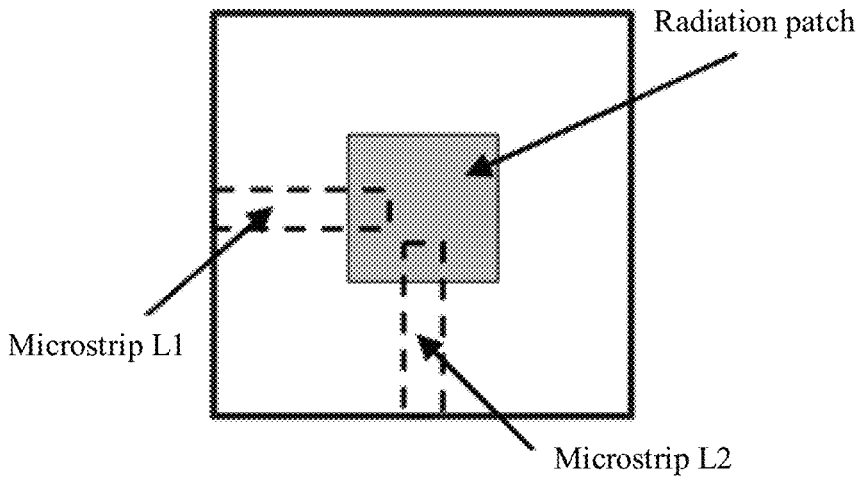
FIG. 1*a* is a schematic plan view of a related art dual-polarized antenna.
Figure 1B:
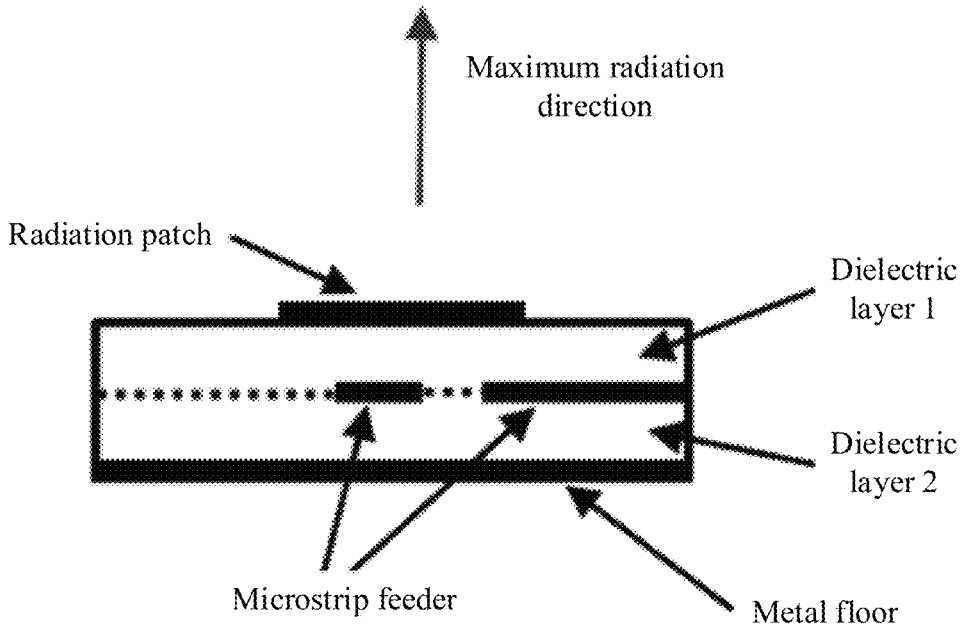
FIG. 1*b* is a schematic side view of the related art dual-polarized antenna.
Figure 2A:
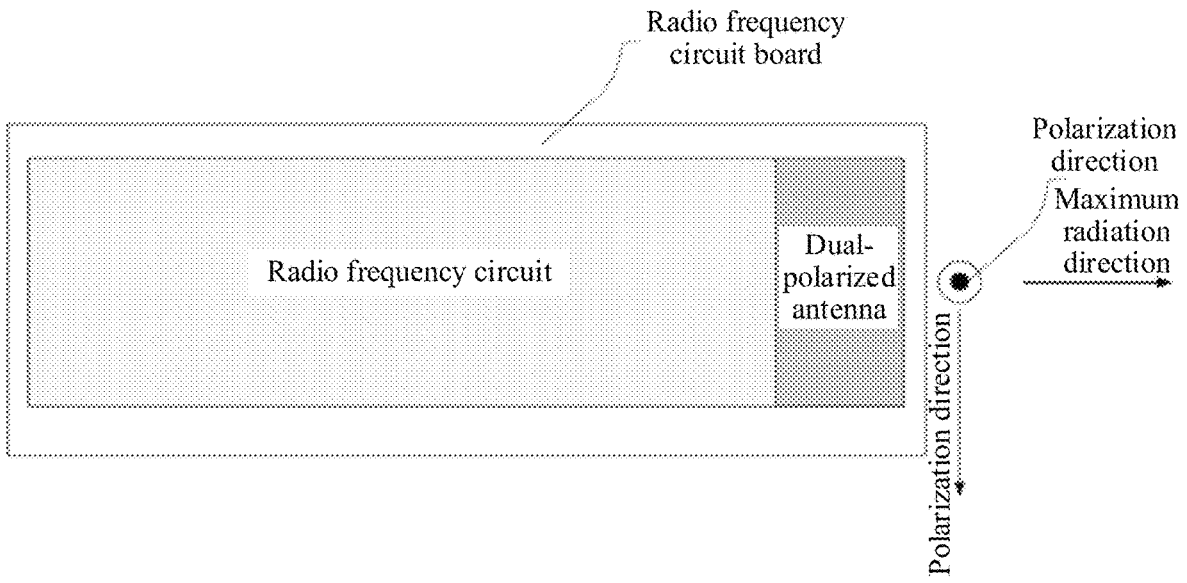
FIG. 2*a* is a schematic structural diagram of a radio frequency front-end apparatus according to an embodiment of the present invention.
Figure 2B:
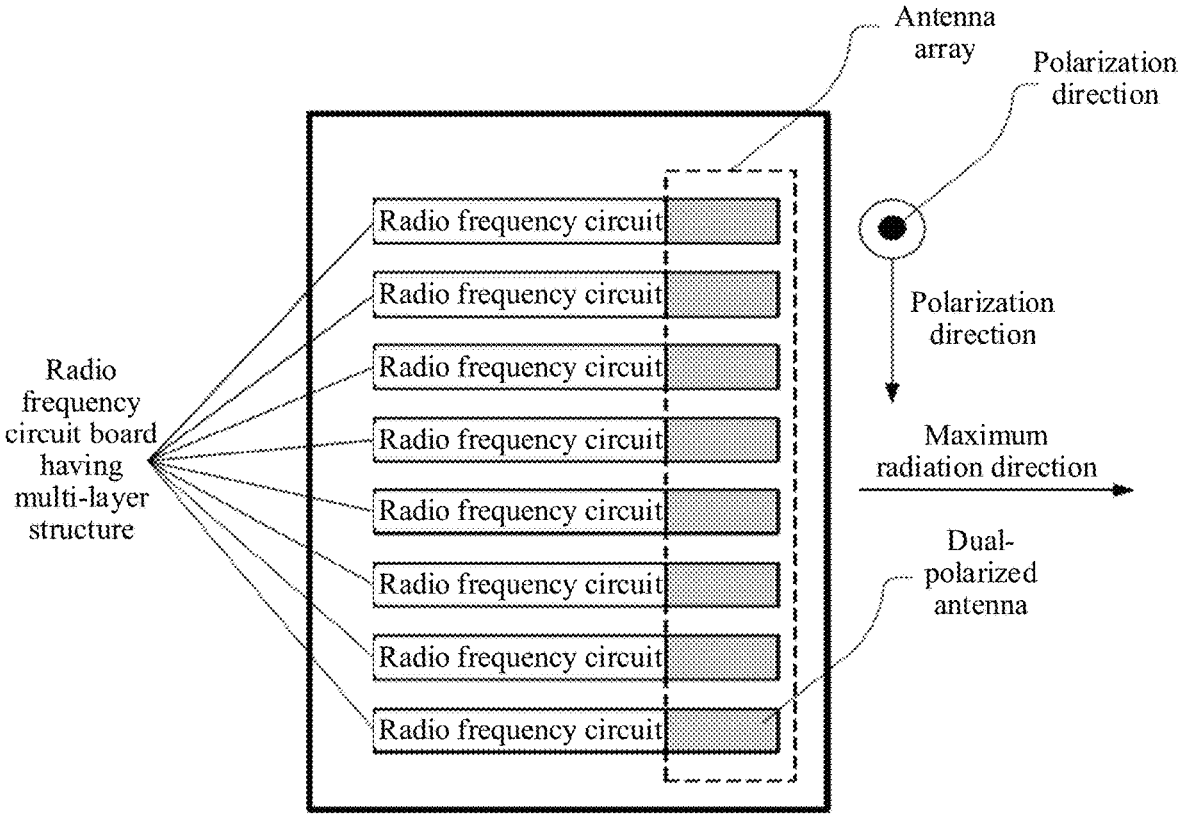
FIG. 2*b* is another schematic structural diagram of a radio frequency front-end apparatus according to an embodiment of the present invention.
Figure 2C:
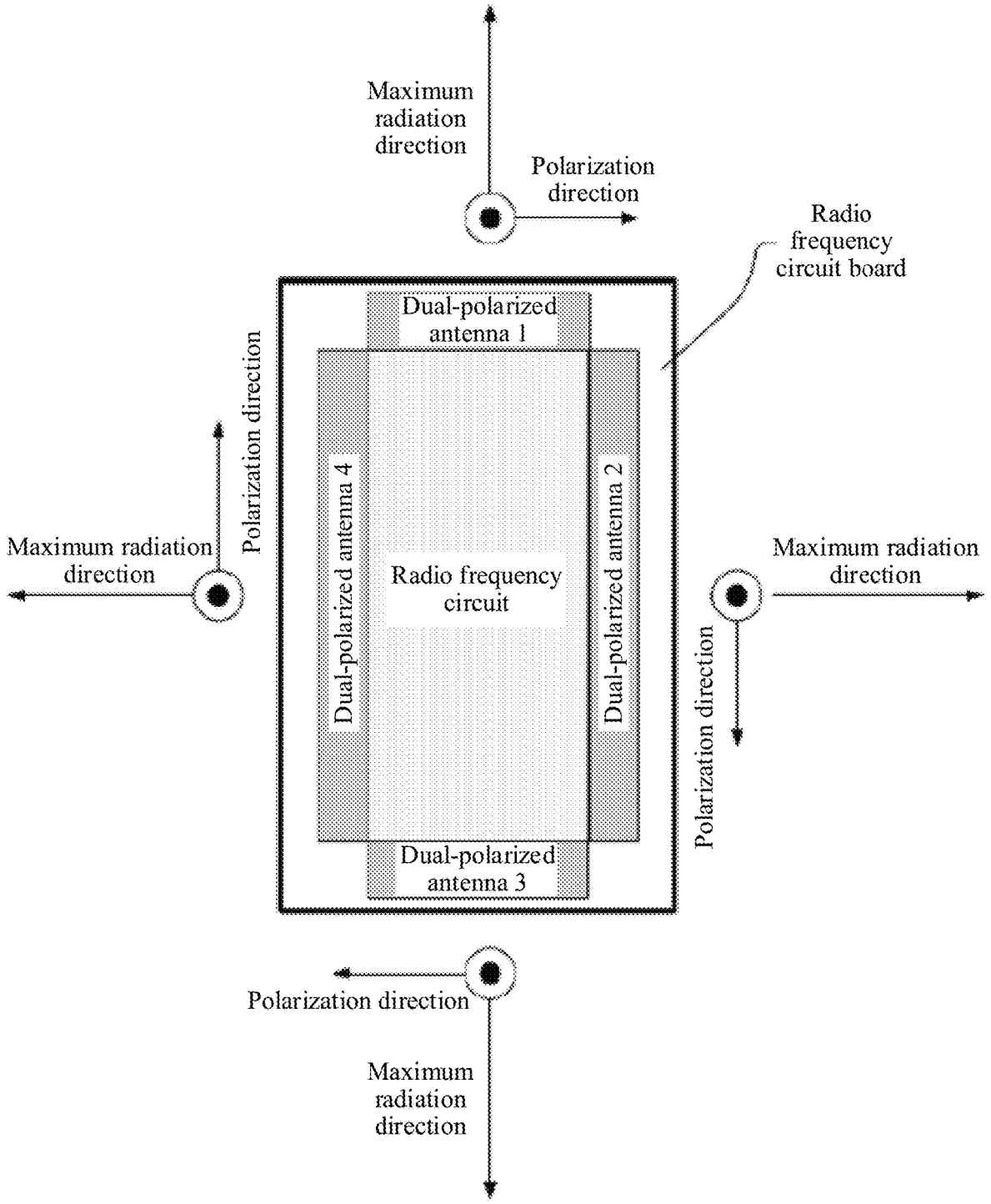
FIG. 2*c* is another schematic structural diagram of a radio frequency front-end apparatus according to an embodiment of the present invention.

Referring to FIG. 2*a* to FIG. 2*c*, FIG. 2*a* is a schematic front view of a radio frequency front-end apparatus according to an embodiment of the present invention. The radio frequency front-end apparatus includes a radio frequency circuit, a dual-polarized antenna, and a radio frequency circuit board. The radio frequency circuit and the dual-polarized antenna are disposed on the radio frequency circuit board, the dual-polarized antenna is a planar antenna, an antenna plane of the dual-polarized antenna is a plane in which an upper surface of the dual-polarized antenna is located. The dual-polarized antenna includes an H-plane horn antenna and a planar end-fire antenna (not shown in FIG. 2*a*), a polarization direction of the H-plane horn antenna is perpendicular to an antenna plane of the dual-polarized antenna. For example, as shown in FIG. 2*a*, the polarization direction of the H-plane horn antenna is perpendicular to the antenna plane and extends inward. The planar end-fire antenna is an antenna of which a polarization direction is parallel to the antenna plane. For example, the planar end-fire antenna includes but is not limited to a Vivaldi antenna, a planar Yagi antenna, a planar log-periodic antenna, or the like. The planar end-fire antenna in this embodiment is parallel to the antenna plane of the dual-polarized antenna, and the antenna plane is also parallel to the radio frequency circuit board. For example, as shown in FIG. 2*a*, a shape of the dual-polarized antenna is a rectangle, and the planar end-fire antenna is parallel to the antenna plane of the dual-polarized antenna and perpendicular to a bottom edge of the dual-polarized antenna. A maximum radiation direction of the dual-polarized antenna is a direction of a main lobe in an antenna pattern. In this embodiment, the maximum radiation direction of the dual-polarized antenna is parallel to the antenna plane, and the maximum radiation direction is perpendicular to the polarization direction of the H-plane horn antenna and a direction of the planar end-fire antenna. For example, the shape of the dual-polarized antenna shown in FIG. 2*a* is the rectangle. The maximum radiation direction of the dual-polarized antenna is parallel to the antenna plane and perpendicular to the polarization direction of the planar end-fire antenna and the polarization direction of the H-plane horn antenna, and the maximum radiation direction is perpendicular to a right side edge of the dual-polarized antenna.

The radio frequency circuit is configured to: send a generated electromagnetic wave signal and process a received electromagnetic wave signal. To reduce interference caused by the dual-polarized antenna to the radio frequency circuit, the radio frequency circuit is located behind the maximum radiation direction of the dual-polarized antenna. For example, if a shape of the radio frequency circuit is a rectangle, and the maximum radiation direction of the dual-polarized antenna is parallel to the radio frequency circuit board and perpendicular to the right side edge of the dual-polarized antenna, the radio frequency circuit is adjacent to a left side edge of the dual-polarized direction.

According to this embodiment of the present invention, the dual-polarized antenna includes the H-plane horn antenna and a planar antenna, the maximum radiation direction of the dual-polarized antenna is parallel to the antenna plane, and the maximum radiation direction is orthogonal to the two polarization directions. Therefore, the radio frequency circuit and the dual-polarized antenna may be disposed on a same radio frequency circuit board, so that problems of a high loss, insufficient space, and a high process requirement that are caused when an antenna interconnection interface is introduced into the related art radio frequency front-end apparatus are avoided.

FIG. 2*b* is a schematic side view of a radio frequency front-end apparatus according to an embodiment of the present invention. In this embodiment of the present invention, the radio frequency front-end apparatus includes a radio frequency circuit board having a multi-layer structure, one radio frequency circuit and one dual-polarized antenna are disposed on each layer of circuit board, and a plurality of dual-polarized antennas form an antenna array. Different dual-polarized antennas in the antenna array have a same polarization direction and a same maximum radiation direction. For a location relationship between two polarization directions and a maximum radiation direction of each dual-polarized antenna, refer to the description of FIG. 2*a*. Details are not described herein again.

In this embodiment of the present invention, the plurality of dual-polarized antennas are enabled, by using a circuit board having a multi-layer structure, to be arranged on a radio frequency front-end module in a form of an array, so that a feature of a high gain can be ensured while a feature of a low profile is implemented, and the antenna array can form a phased array for angle scanning.

FIG. 2*c* is a schematic front view of a radio frequency front-end apparatus according to an embodiment of the present invention. In this embodiment of the present invention, the radio frequency front-end apparatus includes a radio frequency circuit board, and a radio frequency circuit and four dual-polarized antennas disposed on the radio frequency circuit board. The four dual-polarized antennas are distributed around the radio frequency circuit, and the four dual-polarized antennas are all planar antennas. A dual-polarized antenna 1 is located on an upper side of the radio frequency circuit, a dual-polarized antenna 2 is located on a right side of the radio frequency circuit, a dual-polarized antenna 3 is located on a lower side of the radio frequency circuit, and a dual-polarized antenna 4 is located on a left side of the radio frequency circuit. For a location relationship between a polarization direction and a maximum radiation direction of each dual-polarized antenna, refer to the description of FIG. 2*a*. Details are not described herein again. It should be noted that maximum radiation directions of two opposite dual-polarized antennas are in opposite directions. For example, the dual-polarized antenna 1 and the dual-polarized antenna 3 that are at opposite sides have opposite maximum radiation directions, and the dual-polarized antenna 2 and the dual-polarized antenna 4 that are at opposite sides have opposite maximum radiation directions. In addition, maximum radiation directions of the four polarized antennas are divergent outward by using the radio frequency circuit as a center.

Optionally, a shape of the radio frequency circuit is a rectangle. A maximum radiation direction of the dual-polarized antenna 1 is perpendicular to a top edge of the radio frequency circuit, a maximum radiation direction of the dual-polarized antenna 3 is perpendicular to a bottom edge of the radio frequency circuit, a maximum radiation direction of the dual-polarized antenna 2 is perpendicular to a right edge of the radio frequency circuit, and a maximum radiation direction of the dual-polarized antenna 4 is perpendicular to a left side of the radio frequency circuit. A control unit in a terminal device may implement functions such as omnidirectional radiation or angle scanning by controlling enabling or disabling of one or more dual-polarized antennas.

Figure 3A:
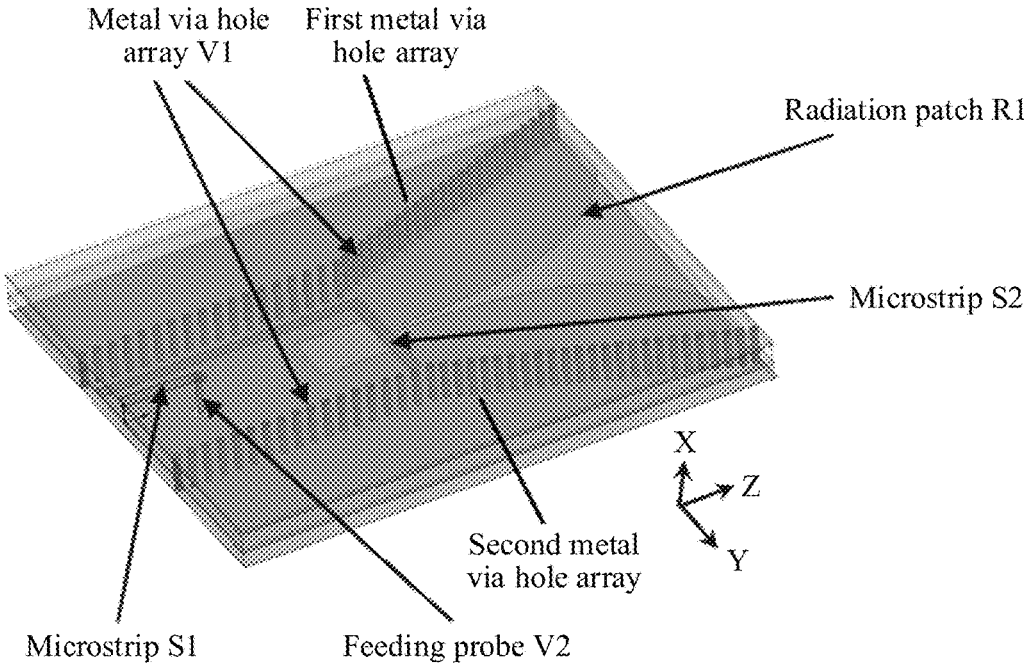
FIG. 3*a* is a schematic assembly perspective view of a dual-polarized antenna according to an embodiment of the present invention.
Figure 3B:
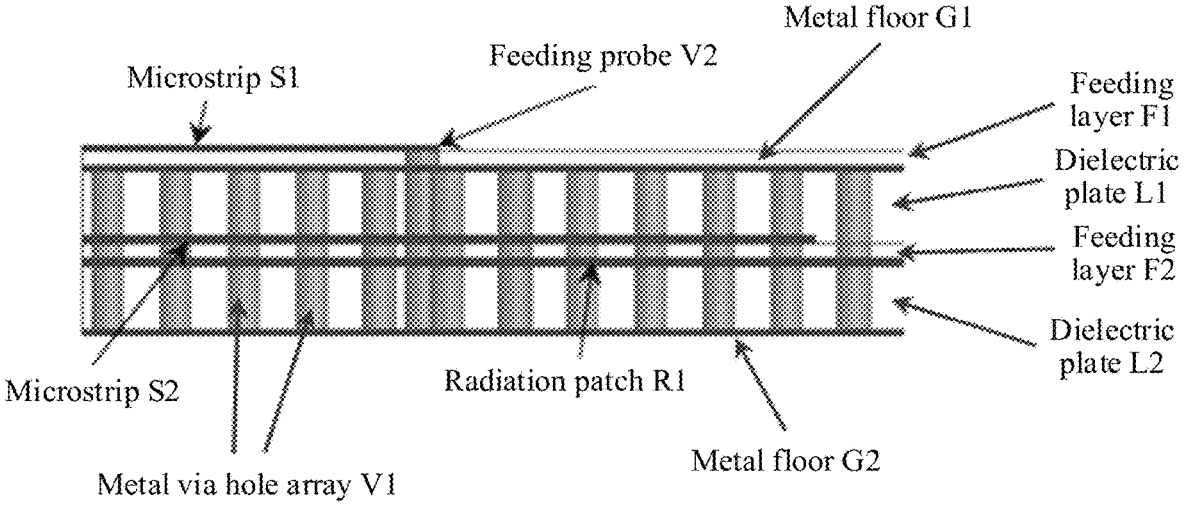
FIG. 3*b* is a schematic side view of a dual-polarized antenna according to an embodiment of the present invention.
Figure 3C:
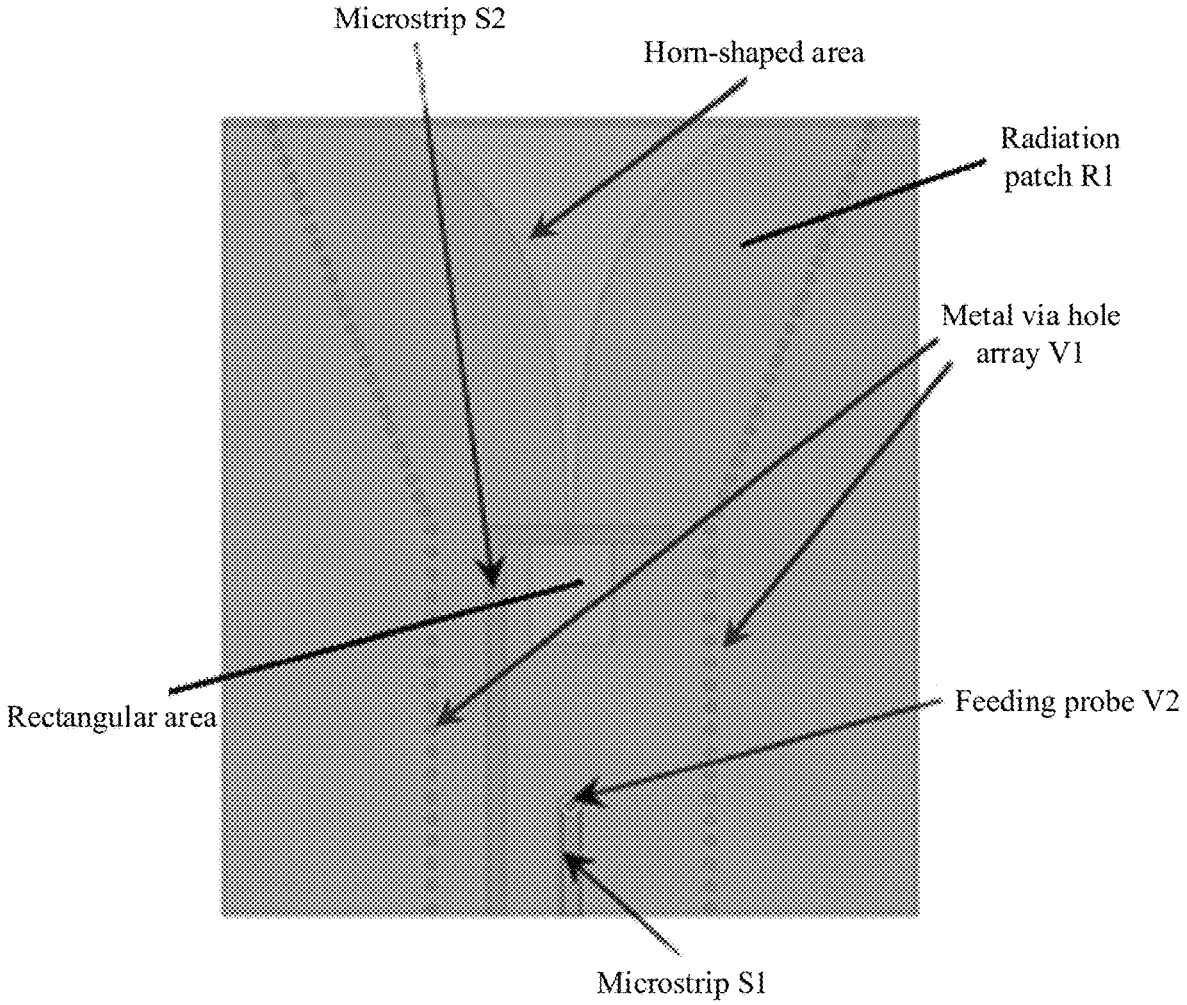
FIG. 3*c* is a schematic plan view of a dual-polarized antenna according to an embodiment of the present invention.

FIG. 3*a* to FIG. 3*c* are schematic structural diagrams of a dual-polarized antenna according to an embodiment of the present invention. In this embodiment of the present invention, the dual-polarized antenna includes an H-plane horn antenna and a planar end-fire antenna, and the H-plane horn antenna includes a first feeding part, a metal via hole array V1, a metal floor G1, and a metal floor G2. The dual-polarized antenna includes a second feeding part and a radiation patch R1.

An antenna plane of the dual-polarized antenna is parallel to the metal floor G1 and the metal floor G2. The metal via hole array V1 includes a first metal via hole array and a second metal via hole array that are oppositely placed. Optionally, the first metal via hole array is parallel to the second metal via hole array. Alternatively, a distance between the first metal via hole array and the second metal via hole array gradually increases linearly. Alternatively, a distance between the first metal via hole array and the second metal via hole array first remains unchanged, and then gradually increases linearly. The metal via hole array V1 includes a plurality of metal via holes. The metal via hole array V1 is located between the metal floor G1 and the metal floor G1. A top end of each metal via hole is connected to the metal floor G1, and a bottom end of each metal via hole is connected to the metal floor G2. The first metal via hole array, the second metal via hole array, the metal floor G1, and the metal floor G1 form a waveguide cavity. The first metal via hole array and the second metal via hole array are used as two side walls of the waveguide cavity, the metal floor G1 is used as a top surface of the waveguide cavity, and the metal floor G2 is used as a bottom surface of the waveguide cavity. The first feeding part is configured to feed the waveguide cavity, to excite the waveguide cavity to generate an electromagnetic wave signal. The radiation patch is parallel to the metal floor G1 and the metal floor G2, and the second feeding part is configured to feed the radiation patch R1, to excite the radiation patch to generate an electromagnetic wave signal.

Optionally, referring to a schematic side view of the dual-polarized antenna shown in FIG. 3*b*, the dual-polarized antenna further includes a dielectric plate L1, a dielectric plate L2, a feeding layer F1, and a feeding layer F2. The antenna plane may be the feeding layer F1. In sequence from top to bottom, a location relationship between layers is: the feeding layer F1, the metal floor G1, the dielectric plate L1, the feeding layer F2, the dielectric plate L2, and the metal floor G2. The dielectric plate L1 and the dielectric plate 2 may be formed by laminating a plurality of layers of dielectric plates. The dielectric plate L1 and the dielectric plate L2 may be made from same dielectric materials. The feeding layer F1 and the feeding layer F2 may also be formed by dielectric materials. The feeding layer F1 and the feeding layer F2 may also be formed by dielectric materials. The dielectric plate L1 is disposed on a lower surface of the metal floor G1, and the feeding layer F1 is disposed on an upper surface of the metal floor G1. Optionally, the dielectric plate L1 completely covers the lower surface of the metal floor G1, and the feeding layer F1 completely covers the upper surface of the metal floor G1. The dielectric plate L2 is disposed on the upper surface of the metal floor G1. For example, the dielectric plate L2 completely covers the upper surface of the metal floor G1. The radiation patch R1 is attached to an upper surface of the dielectric plate L2, the radiation patch R1 does not completely cover the dielectric plate L2, and the second feeding part is disposed on a lower surface of the dielectric plate L1. The feeding layer F2 is located between a second radiation part and the radiation patch R1. Optionally, a shape and a size of the feeding layer F2 are the same as those of the dielectric plate L1 and the dielectric plate L. Optionally, referring to FIG. 3*b*, the planar end-fire antenna is a Vivlaldi antenna. Because the radiation patch R1 does not completely cover the dielectric plate L2, an area that is of the dielectric plate L2 and that is not covered by a radiation patch R1 includes a rectangular area and a horn-shaped area that are in communication with each other, and a maximum radiation direction of the dual-polarized antenna is perpendicular to a horn mouth of the horn-shaped area.

Further, optionally, the first feeding part includes a microstrip S1 and a feeding probe V2. The microstrip S1 is connected to the feeding probe V2, the microstrip S1 covers an upper surface of the feeding layer F1, one vertical through hole is disposed from the feeding layer F1 to the metal floor G2, and the feeding probe V2 is disposed in the through hole. The planar end-fire antenna is the Vivlaldi antenna, the microstrip S2 covers an upper surface of the feeding layer F2, the microstrip S2 is located in the waveguide cavity, and the microstrip S2 excites the radiation patch R1 to generate a polarization direction parallel to the dielectric plates. Optionally, the microstrip S2 includes two perpendicular strips.

According to the foregoing embodiment, the dual-polarized antenna is the planar antenna, the dual-polarized antenna includes the H-plane horn antenna based on an SIW and the Vivlaldi antenna, the maximum radiation direction of the dual-polarized antenna is parallel to the antenna plane and perpendicular to the horn mouth, a polarization direction of the H-plane horn antenna is perpendicular to the antenna plane and perpendicular to the maximum radiation direction, and a polarization direction of the Vivlaldi antenna is parallel to the antenna plane and perpendicular to the maximum radiation direction. In this way, the radio frequency circuit may be disposed at a side opposite to the maximum radiation direction of the dual-polarized antenna, and is located on a same circuit board as the dual-polarized antenna, a feature of a low profile is implemented, and the radio frequency circuit and the dual-polarized antenna do not need to be connected by using an interconnection plug, thereby reducing an insertion loss and reducing an assembly difficulty.

Figure 4A:
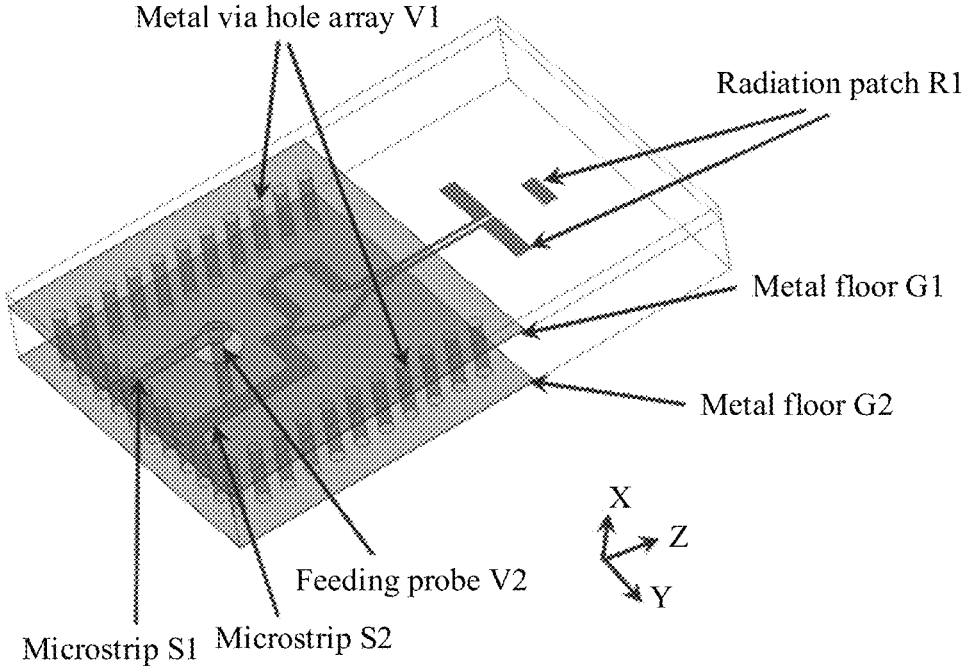
FIG. 4*a* is another schematic assembly perspective view of a dual-polarized antenna according to an embodiment of the present invention.
Figure 4B:
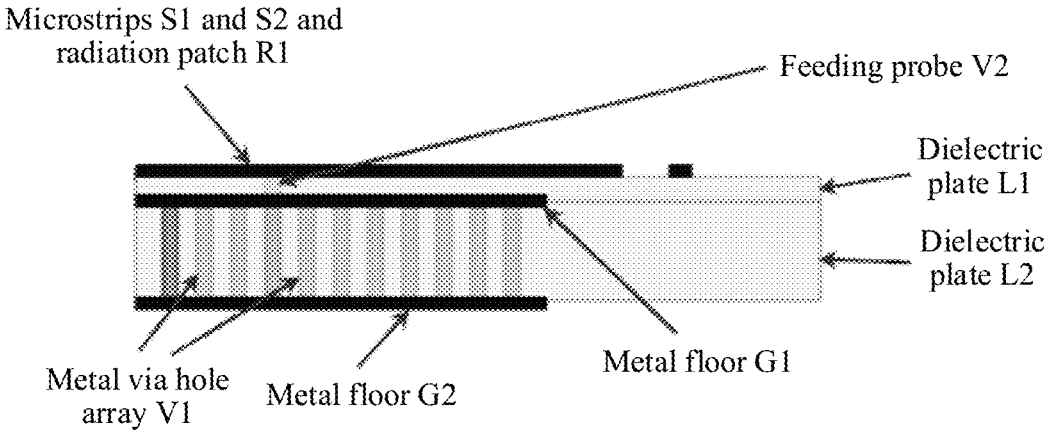
FIG. 4*b* is another schematic side view of a dual-polarized antenna according to an embodiment of the present invention.
Figure 4C:
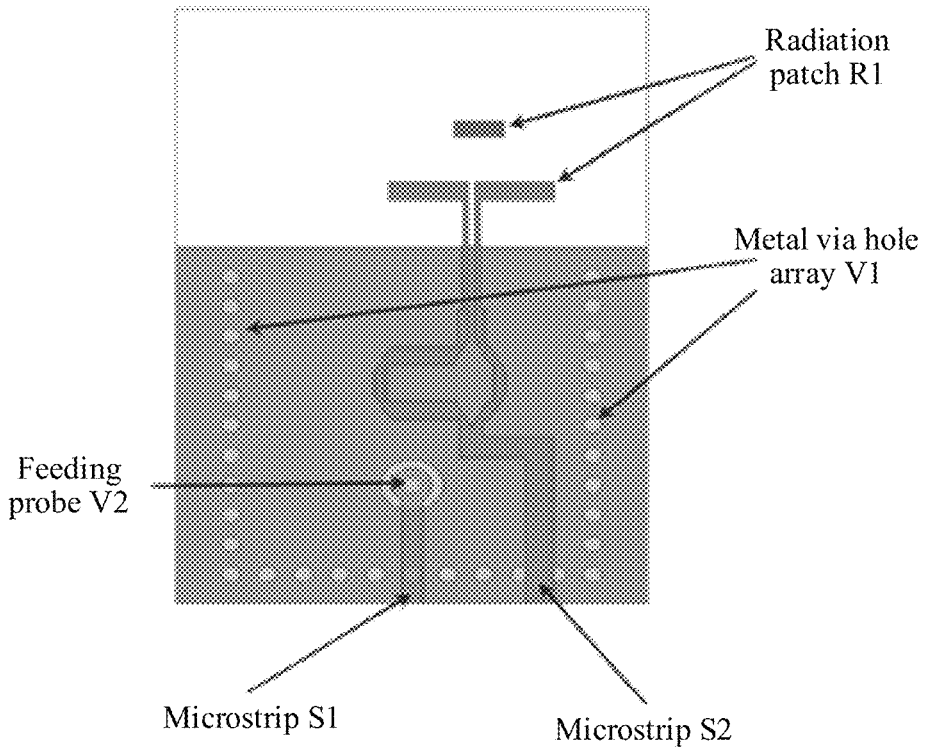
FIG. 4*c* is another schematic plan view of a dual-polarized antenna according to an embodiment of the present invention.

FIG. 4*a* to FIG. 4*c* are other schematic structural diagrams of a dual-polarized antenna according to an embodiment of the present invention. In this embodiment of the present invention, the dual-polarized antenna includes an H-plane horn antenna and a planar end-fire antenna, the H-plane horn antenna includes a metal via hole array V1, a metal floor G1, a metal floor G2, and a first feeding part, and the planar end-fire antenna includes a second feeding part and a radiation patch R1. An antenna plane of the dual-polarized antenna is parallel to the metal floor G1 and the metal floor G2.

The metal floor G1 is parallel to the metal floor G2, the metal via hole array V1 is disposed between the metal floor G1 and the metal floor G2, the metal via hole array V1 includes three metal via hole arrays that are in a shape of a half-encircled rectangle, the metal via hole array V1 is located between the metal floor G1 and the metal floor G1, the metal via hole array V1 includes a plurality of metal via holes perpendicular to the metal floor G1 and the metal floor G2, a top end of each metal via hole is connected to the metal floor G1, and a bottom end of each metal via hole is connected to the metal floor G2. The metal floor G1, the metal floor G2, and the metal via hole array V1 form a waveguide cavity, the metal via hole array V1 is used as a side wall of the waveguide cavity, the metal floor G1 is used as a top surface of the waveguide cavity, and the metal floor G2 is used as a bottom surface of the waveguide cavity. The first feeding part is configured to feed the waveguide cavity, to excite the waveguide cavity to generate an electromagnetic wave signal, where a polarization direction of the generated electromagnetic wave signal is perpendicular to the antenna plane. The radiation patch R1 is parallel to the metal floor G1 and the metal floor G2, and the second feeding part is configured to feed the radiation patch R1, to excite the radiation patch R1 to generate an electromagnetic wave signal.

Optionally, FIG. 4*b* is a schematic side view of the dual-polarized antenna. The dual-polarized antenna further includes a dielectric plate L1 and a dielectric plate L2. The antenna plane of the dual-polarized antenna is the dielectric plate L1, the dielectric plate L1 is located on an upper layer of the metal floor G1, the dielectric plate L2 is located between the metal floor G1 and the metal floor G2, and a plurality of through holes for the metal via hole array V1 to pass through are disposed on the dielectric plate L2.

Further, optionally, FIG. 4*c* is a schematic front view of the dual-polarized antenna. The first feeding part includes a microstrip S1 and a feeding probe V2. A through hole is disposed on an upper surface of the dielectric plate L1, and the feeding probe V2 is located in the through hole. The planar end-fire antenna is a Yagi antenna, the second feeding part includes a microstrip S2, the microstrip S2 may be an S-shaped cable, and the radiation patch R1 is disposed on the upper surface of the dielectric plate L1, where the radiation patch R1 may include a plurality of metal patches parallel to a horn mouth of the H-plane horn antenna.

In conclusion, according to this embodiment of the present invention, the dual-polarized antenna is the planar antenna, the dual-polarized antenna includes the H-plane horn antenna based on an SIW and the Yagi antenna, a maximum radiation direction of the dual-polarized antenna is parallel to an antenna plane and perpendicular to the horn mouth, a polarization direction of the H-plane horn antenna is perpendicular to the antenna plane and perpendicular to the maximum radiation direction, and a polarization direction of the Yagi antenna is parallel to the antenna plane and perpendicular to the maximum radiation direction. In this way, the radio frequency circuit may be disposed at a side opposite to the maximum radiation direction of the dual-polarized antenna, and is located on a same circuit board as the dual-polarized antenna, a feature of a low profile is implemented, and the radio frequency circuit and the dual-polarized antenna do not need to be connected by using an interconnection plug, thereby reducing an insertion loss and reducing an assembly difficulty. In addition, in this embodiment, a feeding layer does not need to be introduced in the dual-polarized antenna, thereby reducing a thickness of the antenna.

Figure 5A:
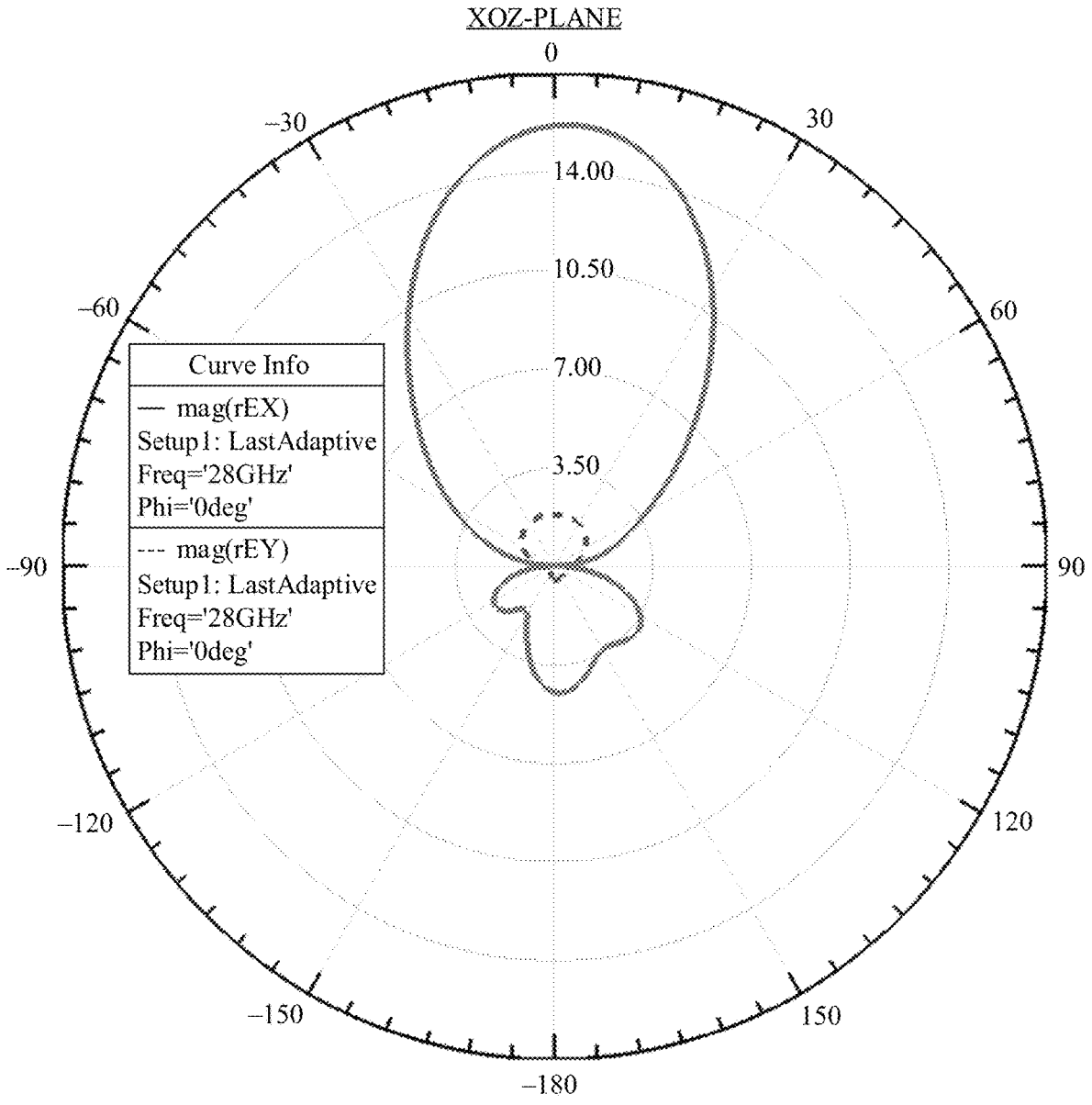
FIG. 5*a* to FIG. 5*d* are electric field radiation patterns of a dual-polarized antenna according to an embodiment of the present invention.
Figure 5B:
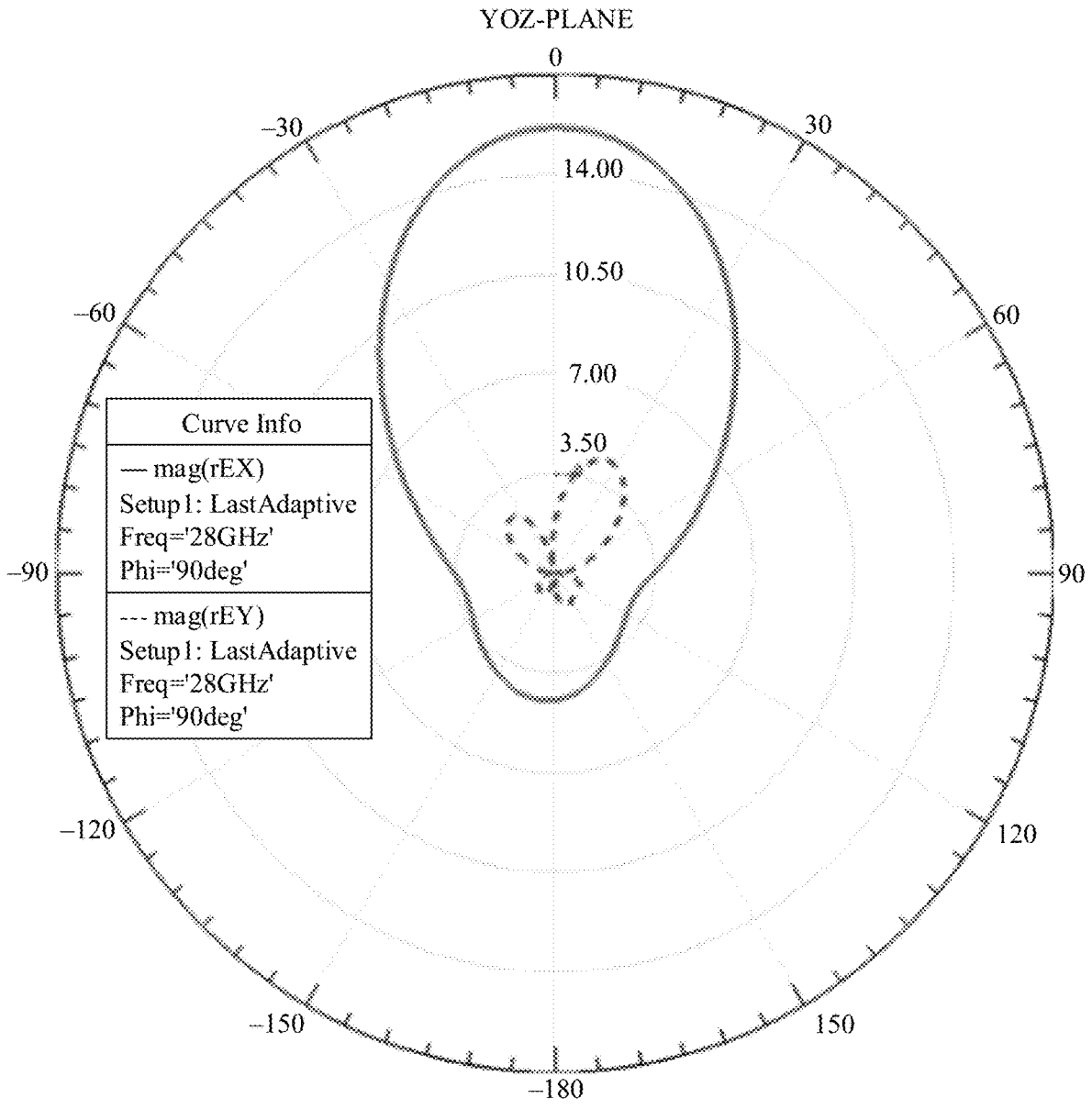
Figure 5C:
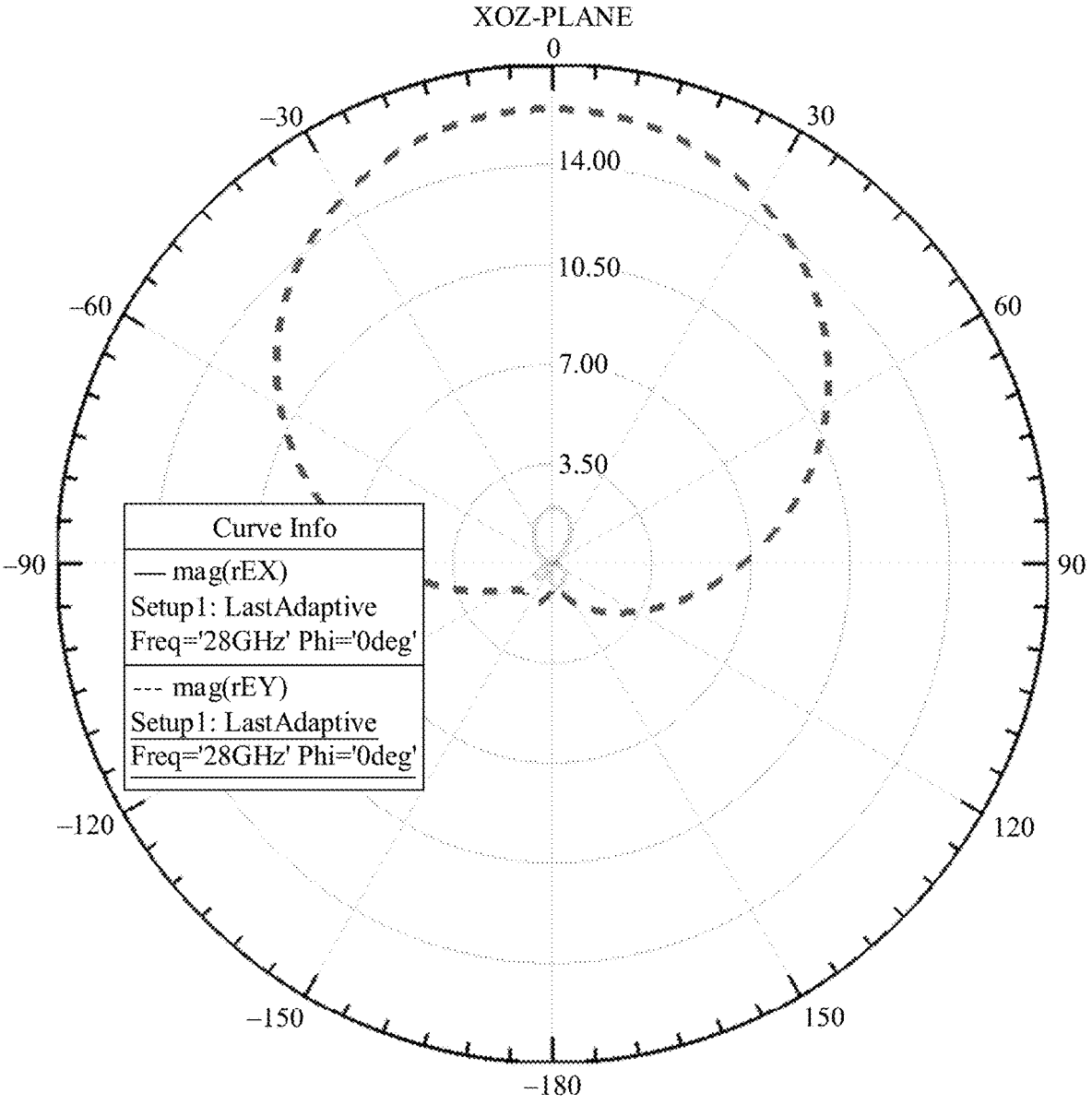
Figure 5D:
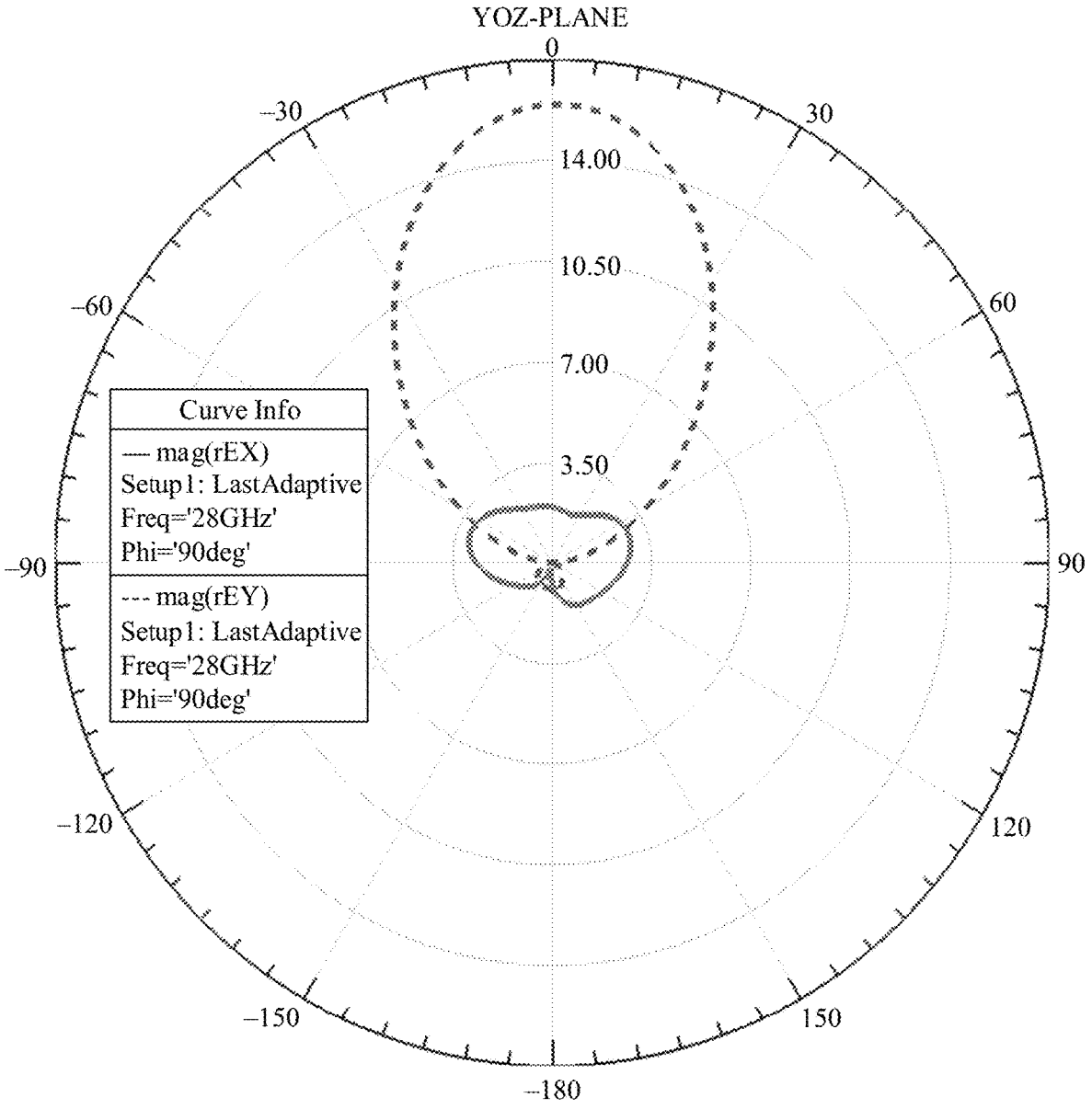

FIG. 5*a* to FIG. 5*d* are electric field radiation patterns of a dual-polarized antenna according to an embodiment of the present invention. In this embodiment of the present invention, a three-dimensional coordinate system is set for the dual-polarized antenna, and an antenna plane is parallel to a YOZ plane. FIG. 5*a* is an electric field radiation pattern of an H-plane horn antenna in an XOZ plane, FIG. 5*b* is an electric field radiation pattern of the H-plane horn antenna in a YOZ plane, FIG. 5*c* is an electric field radiation pattern of a planar end-fire antenna in the XOZ plane, and FIG. 5*d* is an electric field radiation pattern of the planar end-fire antenna in the YOZ plane.

It can be learned that maximum radiation directions of the H-plane horn antenna and the planar end-fire antenna are both +Z-axis directions, and the maximum radiation directions are parallel to the antenna plane (that is, the YOZ plane). A direction of a maximum electric field of the H-plane horn antenna is an X-axis direction and is perpendicular to the antenna plane, and polarization in one direction (for example, vertical polarization) is implemented. A direction of a maximum electric field of the planar end-fire antenna is a Y-axis direction and is parallel to the antenna plane, and polarization in another direction (for example, horizontal polarization) orthogonal to the polarization direction of the H-plane horn antenna is implemented.

In the foregoing implementations, schematic structural diagrams or schematic simulation diagrams are merely examples for describing the technical solutions of the present invention, and the size proportion and the simulation value do not constitute a limitation on the protection scope of the technical solutions. Any modification, equivalent replacement, and improvement made without departing from the spirit and principle of the foregoing implementations shall fall within the protection scope of the technical solutions.

What is claimed is:

1. A dual-polarized antenna, comprising an H-plane horn antenna and a planar end-fire antenna, wherein the dual-polarized antenna is a planar antenna, a polarization direction of the H-plane horn antenna is perpendicular to an antenna plane of the dual-polarized antenna, polarization direction of the planar end-fire antenna is parallel to the antenna plane, the polarization direction of the H-plane horn antenna is perpendicular to the polarization direction of the planar end-fire antenna, a maximum radiation direction of the dual-polarized antenna is parallel to the antenna plane, and the maximum radiation direction of the dual-polarized antenna is perpendicular to the polarization direction of the H-plane horn antenna and the polarization direction of the planar end-fire antenna.

2. The antenna according to claim 1, wherein
the H-plane horn antenna comprises a first feeding part, a metal via hole array, a first metal floor, and a second metal floor,
the metal via hole array comprises a first metal via hole array and a second metal via hole array,
the first metal floor and the second metal floor are parallel to the antenna plane,
the first metal floor is parallel to the second metal floor,
the metal via hole array is located between the first metal floor and the second metal floor,
a top end of each metal via hole in the metal via hole array is electrically connected to the first metal floor,
a bottom end of each metal via hole is connected to the second metal floor,
the first metal via hole array and the second metal via hole array are perpendicular to the first metal floor and the second metal floor,
the first metal floor, the second metal floor, and the metal via hole array form a waveguide cavity,
the first feeding part is configured to feed the waveguide cavity,
the planar end-fire antenna comprises a second feeding part and a radiation patch,
the second feeding part is configured to feed the radiation patch, and
the radiation patch is parallel to the first metal floor and the second metal floor.

3. The antenna according to claim 2, wherein a distance between the first metal via hole array and the second metal via hole array first remains unchanged at a first portion between the first metal via hole array and the second metal via hole array, and then gradually increases linearly at a second portion between the first metal via hole array and the second metal via hole array.

4. The antenna according to claim 2, further comprising a first dielectric plate, a second dielectric plate, a first feeding layer, and a second feeding layer, wherein
the first dielectric plate is disposed on a lower surface of the first metal floor,
the first feeding layer is disposed on an upper surface of the first metal floor,
the second dielectric plate is disposed on an upper surface of the second metal floor,
the second feeding layer is disposed between a lower surface of the first dielectric plate and an upper surface of the second dielectric plate,
the radiation patch is disposed between a lower surface of the second feeding layer and the upper surface of the second dielectric plate, and
the second feeding part is disposed between an upper surface of the second feeding layer and a lower surface of the first dielectric plate.

5. The antenna according to claim 4, wherein
the first feeding part comprises a first microstrip and a feeding probe,
wherein the first microstrip is electrically connected to the feeding probe,
the first microstrip is disposed on an upper surface of the first feeding layer,
a through hole perpendicular to the first feeding layer is disposed on the upper surface of the first feeding layer,
the feeding probe is located in the through hole,
the second feeding part comprises a second microstrip,
wherein the second microstrip is disposed between the lower surface of the first dielectric plate and the upper surface of the second feeding layer, and
the second microstrip is in the waveguide cavity.

6. The antenna according to claim 5, wherein
the planar end-fire antenna is a Vivaldi antenna,
a rectangular area and a horn-shaped area that are in communication with each other are formed in an area that is of the upper surface of the second dielectric layer and that is not covered by the radiation patch, and
a horn mouth of the horn-shaped area is perpendicular to the maximum radiation direction.

7. The antenna according to claim 5, wherein the second microstrip comprises two strips that are perpendicular to each other.

8. The antenna according to claim 2, further comprising a first dielectric plate and a second dielectric plate, wherein
the first metal floor is disposed between a lower surface of the first dielectric plate and an upper surface of the second dielectric plate, and
the second metal floor is disposed on a lower surface of the second dielectric plate.

9. The antenna according to claim 8, wherein
the first feeding part comprises a first microstrip and a feeding probe,
the first microstrip is disposed on an upper surface of the first dielectric plate,
the first microstrip is electrically connected to the feeding probe,
a through hole is disposed on the upper surface of the first dielectric plate,
the feeding probe is located in the through hole,
the second feeding part comprises a second microstrip, and
the second microstrip and the radiation patch are disposed on the first dielectric plate.

10. A radio frequency front-end apparatus, comprising a radio frequency circuit board, a radio frequency circuit, and a dual-polarized antenna, wherein
the dual-polarized antenna and the radio frequency circuit are disposed on the radio frequency circuit board,
an antenna plane of the dual-polarized antenna is parallel to the radio frequency circuit board,
the dual-polarized antenna is a planar antenna,
a polarization direction of the H-plane horn antenna is perpendicular to an antenna plane of the dual-polarized antenna,
a polarization direction of the planar end-fire antenna is parallel to the antenna plane,
the polarization direction of the H-plane horn antenna is perpendicular to the polarization direction of the planar end-fire antenna,
a maximum radiation direction of the dual-polarized antenna is parallel to the antenna plane, and
the maximum radiation direction of the dual-polarized antenna is perpendicular to the polarization direction of the H-plane horn antenna and the polarization direction of the planar end-fire antenna.

11. The apparatus according to claim 10, wherein
the H-plane horn antenna comprises a first feeding part, a metal via hole array, a first metal floor, and a second metal floor,
wherein the metal via hole array comprises a first metal via hole array and a second metal via hole array,
the first metal floor and the second metal floor are parallel to the antenna plane;
the first metal floor is parallel to the second metal floor,
the metal via hole array is located between the first metal floor and the second metal floor, a top end of each metal via hole in the metal via hole array is electrically connected to the first metal floor, a bottom end of each metal via hole is connected to the second metal floor, the first metal via hole array and the second metal via hole array are perpendicular to the first metal floor and the second metal floor, the first metal floor, the second metal floor, and the metal via hole array form a waveguide cavity, the first feeding part is configured to feed the waveguide cavity, the planar end-fire antenna comprises a second feeding part and a radiation patch, the second feeding part is configured to feed the radiation patch, and the radiation patch is parallel to the first metal floor and the second metal floor.

12. The apparatus according to claim 11, wherein a distance between the first metal via hole array and the second metal via hole array first remains unchanged at a first portion between the first metal via hole array and the second metal via hole array, and then gradually increases linearly at a second portion between the first metal via hole array and the second metal via hole array.

13. The apparatus according to claim 11, wherein the dual-polarized antenna further comprising a first dielectric plate, a second dielectric plate, a first feeding layer, and a second feeding layer, the first dielectric plate is disposed on a lower surface of the first metal floor, the first feeding layer is disposed on an upper surface of the first metal floor, the second dielectric plate is disposed on an upper surface of the second metal floor, the second feeding layer is disposed between a lower surface of the first dielectric plate and an upper surface of the second dielectric plate, the radiation patch is disposed between a lower surface of the second feeding layer and the upper surface of the second dielectric plate, and the second feeding part is disposed between an upper surface of the second feeding layer and a lower surface of the first dielectric plate.

14. The apparatus according to claim 13, wherein the first feeding part comprises a first microstrip and a feeding probe, the first microstrip is electrically connected to the feeding probe, the first microstrip is disposed on an upper surface of the first feeding layer, a through hole perpendicular to the first feeding layer is disposed on the upper surface of the first feeding layer, the feeding probe is located in the through hole, the second feeding part comprises a second microstrip, the second microstrip is disposed between the lower surface of the first dielectric plate and the upper surface of the second feeding layer, and the second microstrip is in the waveguide cavity.

15. The apparatus according to claim 14, wherein the planar end-fire antenna is a Vivaldi antenna, a rectangular area and a horn-shaped area that are in communication with each other are formed in an area that is of the upper surface of the second dielectric layer and that is not covered by the radiation patch, and a horn mouth of the horn-shaped area is perpendicular to the maximum radiation direction.

16. The apparatus according to claim 14, wherein the second microstrip comprises two strips that are perpendicular to each other.

17. The apparatus according to claim 11, the dual-polarized antenna further comprising a first dielectric plate and a second dielectric plate, wherein the first metal floor is disposed between a lower surface of the first dielectric plate and an upper surface of the second dielectric plate, and the second metal floor is disposed on a lower surface of the second dielectric plate.

18. The apparatus according to claim 17, wherein the first feeding part comprises a first microstrip and a feeding probe, the first microstrip is disposed on an upper surface of the first dielectric plate, the first microstrip is electrically connected to the feeding probe, a through hole is disposed on the upper surface of the first dielectric plate, the feeding probe is located in the through hole;

the second feeding part comprises a second microstrip, and the second microstrip and the radiation patch are disposed on the first dielectric plate.

* * * * *